US005818679A

United States Patent [19]

Schustek et al.

[11] Patent Number: 5,818,679

[45] Date of Patent: Oct. 6, 1998

[54] SWITCHING DEVICE FOR SOLENOID SWITCH

[75] Inventors: Siegfried Schustek, Ditzingen; Manfred Ackermann, Oppenweiler; Gerd Kirsten, Kornwestheim, all of Germany

[73] Assignee: Robert Bosch GmbH, Stuttgart, Germany

[21] Appl. No.: 817,855

[22] PCT Filed: Jan. 9, 1996

[86] PCT No.: PCT/DE96/00019

§ 371 Date: Apr. 24, 1997

§ 102(e) Date: Apr. 24, 1997

[87] PCT Pub. No.: WO96/24149

PCT Pub. Date: Aug. 8, 1996

[30] Foreign Application Priority Data

Feb. 3, 1995 [DE] Germany ..... 195 03 536.4

[51] Int. Cl.[6] ..... H01H 47/22

[52] U.S. Cl. ..... 361/154; 307/10.6

[58] Field of Search ..... 361/152–156; 307/10.6

[56] References Cited

U.S. PATENT DOCUMENTS

| | | | |
|---|---|---|---|
| 4,755,688 | 7/1988 | Isozumi . | |
| 4,896,637 | 1/1990 | Yamamoto | 307/10.6 |
| 5,053,911 | 10/1991 | Kopec et al. | 361/154 |
| 5,107,391 | 4/1992 | Siepmann | 361/168.1 |

*Primary Examiner*—Fritz Fleming
*Attorney, Agent, or Firm*—Michael Striker

[57] ABSTRACT

The circuit arrangement for an auxiliary relay that actuates a starting relay for a starter device of an internal combustion engine includes a temperature measuring device (20) and a control and/or regulating circuit device (16,16') for controlling, in a turned-on state, an operating current (I) flowing through a relay coil of the auxiliary relay according to a temperature of the auxiliary relay or starting relay measured by the temperature measuring device (20) so that the operating current (I) and mean value of the operating current (I) are controlled according to the temperature. The control and/or regulating circuit clocks the operating current and can vary the duty cycle to reduce the power losses.

13 Claims, 3 Drawing Sheets

Fig. 3
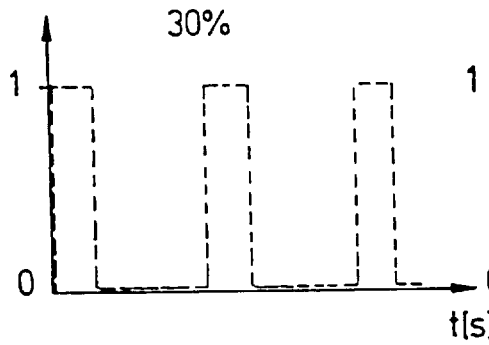
Fig. 4
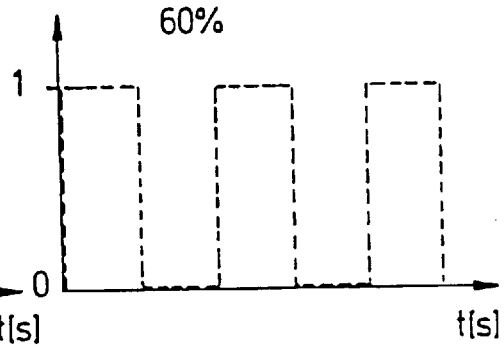
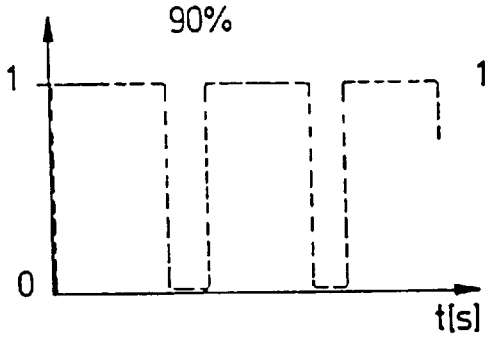
Fig. 5
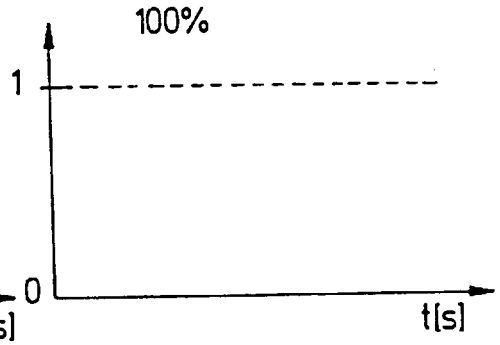
Fig. 6

SWITCHING DEVICE FOR SOLENOID SWITCH

BACKGROUND OF THE INVENTION

The invention relates to a circuit arrangement for a starting relay for a starter of an internal combustion engine.

In motor vehicles, it is known to use starting relays for a starter device of an internal combustion engine. These starting relays are used to switch a high current with a relatively low control current. The high current (starter current, necessary for turning over an engine by means of a starter), amounts to as much as approximately 1000 A in passenger cars, for instance. The current flowing during the starting process via the relay coil of the starting relay, by comparison, is about 80 to 100 A, for instance. This relatively low current compared with the starter current is still too high, however, to be switched directly via a starting switch (ignition lock) or via an electronic control unit. To that end, it is known from German Patent DE 37 37 430 C, among other sources, to assign the starting relay an auxiliary relay, which is actuatable by means of the starter switch of the motor vehicle. One disadvantage is that for the additional auxiliary relay not only must additional installation space in the motor vehicle be made available; besides, this relay is one additional consumer with a correspondingly high power loss.

SUMMARY OF THE INVENTION

It is an object of the present invention to provide a circuit arrangement of the above-described type which eliminates the above-described disadvantages.

According to the invention, the circuit arrangement for an auxiliary relay that actuates a starting relay for a starter device of an internal combustion engine includes a temperature measuring means and control and/or regulating circuit means for controlling, in a turned-on state, an operating current flowing through a relay coil of the auxiliary relay according to a temperature measured by the temperature measuring means so that the operating current and mean value of the operating current are controlled according to the temperature of the auxiliary relay or the starting relay.

The circuit arrangement according to the invention offers the advantage that the auxiliary relay can be optimized, that is, reduced with respect to its structural size in particular, so that less installation space has to be made available. Because a control and/or regulating circuit is provided that varies the operating current of the auxiliary relay, it is advantageously possible to vary the operating current of the auxiliary relay as a function of selectable criteria in such a way that for every operating state of the auxiliary relay its operating current assumes only the actual magnitude necessary, so that the power loss occurring at the auxiliary relay is reduced as greatly as possible. It thus becomes possible to integrate the auxiliary relay with the starting relay, producing a compact structural unit.

In an advantageous feature of the invention it is provided that the control circuit includes a clocked control or current regulating circuit; via the clock frequency and/or the duty cycle, the magnitude of the operating current can be fixed as a function of certain operating states of the auxiliary relay. This advantageously makes it possible to adapt the operating current of the auxiliary relay to varying operating conditions, such as an operating temperature and/or an armature position of the auxiliary relay. By means of this optimal adaptation of the operating current to each operating state of the auxiliary relay, the power loss of the auxiliary relay is reduced. This is the result in particular of a lowering of the operating current, once the armature of the auxiliary relay has attracted, or has just begun its motion along its path of motion. It is also advantageous that by optimal controlled clocking of the operating current of the auxiliary relay, it is possible to set a constant high mean operating current value under various operating conditions, and especially various temperature conditions. It should be taken into account that at different temperatures, on the one hand the characteristic curve of a retraction spring for the armature of the auxiliary relay and on the other the magnetization behavior of the auxiliary relay and the ohmic resistance of the coil vary, with the consequence that the operating current of the auxiliary relay varies as well. As a rule, the coil of the auxiliary relay should be dimensioned in accordance with the maximum incident operating current. However, by controlling the auxiliary relay operating current in accordance with the invention it becomes possible to operate the auxiliary relay at a lower, constantly high, clocked mean operating current value, so that the various operating conditions can be responded to via a choice of a set-point current value, a clock frequency, and/or the duty cycle. By this means, the coil can now be designed for the maximum current at the highest operating temperature.

Further advantageous features of the invention will become apparent from the other characteristics recited in the dependent claims.

BRIEF DESCRIPTION OF THE DRAWING

The invention is described in further detail below in exemplary embodiments in conjunction with the associated drawings. Shown are:

FIGS. 3–6, several signal courses for various duty cycles of the clocked operating current of the auxiliary relay;

DESCRIPTION OF THE EXEMPLARY EMBODIMENTS

Figure 1:
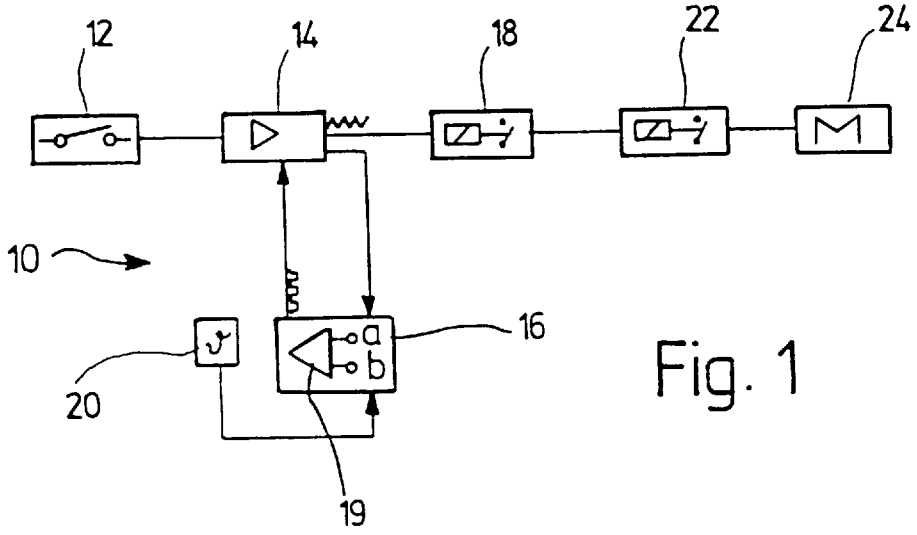
FIG. 1, a schematic block circuit diagram of a circuit arrangement according to the invention.

FIG. 1 shows a circuit arrangement, identified overall by reference numeral 10, for a device for starting an internal combustion engine. The circuit arrangement 10 has a turn-on element 12, such as an ignition lock or starting switch, that is connected to an electronic control unit 14. The electronic control unit 14 has a control circuit 16 for an auxiliary relay 18 connected to the control unit 14. The control circuit 16 is also assigned a temperature detection circuit 20, which is connected to temperature sensors, not shown here, that are disposed in the vicinity of the auxiliary relay 18 or in the engine compartment. The control circuit 16 includes a trigger stage 19, acting as a Schmitt trigger, whose response values a) and b) are variable, and which sense the current course at the output of the control unit 14.

The control unit 14 has further circuit elements, not relevant here, that are necessary for the function of the motor vehicle. Switch contacts, not shown here, of the auxiliary relay 18 are connected to the windings of a starting relay 22;

its switch contacts, likewise not shown, turn the main current circuit of a starter device 24 on and off.

The mode of operation of the circuit arrangement 10 will be briefly explained, referring to the merely schematic drawing. On actuation of the turn-on element 12, the coil of the auxiliary relay 18 is supplied with current via the electronic control unit 14. Supplying the current to the auxiliary relay 18 is effected, in a manner to be described hereinafter, via the control circuit 16 for the operating current of the auxiliary relay 18. The switch contacts of the auxiliary relay 18 connect the relay coil of the starting relay 22 to an operating voltage, so that the armature of the starting relay 22 closes the main current contacts of the starter device 24 and connects them with a voltage source, which in a motor vehicle is as a rule the vehicle battery. Via the main current contacts of the starter device 24, the relatively high starter current now flows; it can amount to approximately 1000 A. Via the switch contacts of the auxiliary relay 18, which connect the relay coil of the starting relay 22 to the voltage source, a switching current at the level of about 80 to 100 A flows. Via the coil of the auxiliary relay 18, the operating current I of up to 40 A flows, being varied by the control circuit 16 of the control unit 14.

Figure 2:
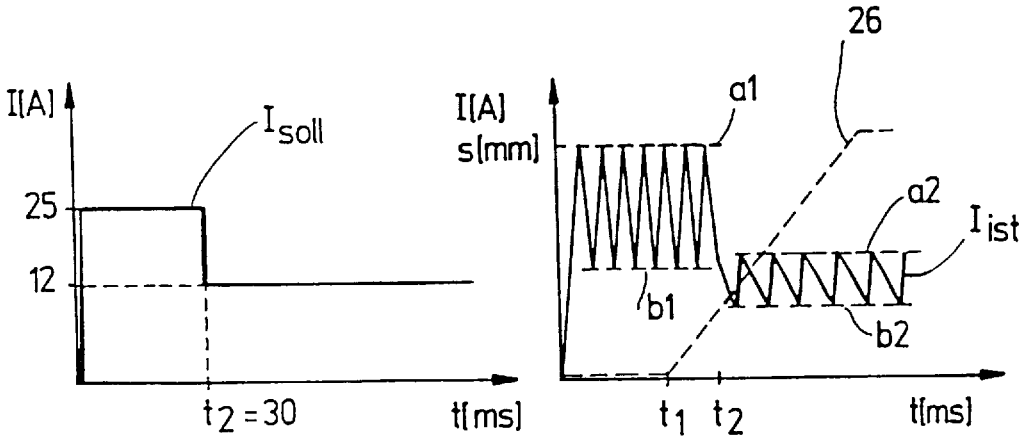
FIG. 2, a diagram of the course of the set-point and actual value of the operating current of the auxiliary relay for the embodiment of FIG. 1.

In FIG. 2, the set-point value and actual value of the operating current are shown in the exemplary embodiment for controlling the operating current I of FIG. 1. The set-point value $I_{soll}$ of the operating current is lowered to a lower value at time t2 by the control circuit 16. As a result, the actual value of the operating current, $I_{ist}$, shown in simplified form on the left, is established. This takes into account the physical facts that for retention of the armature of the auxiliary relay 18, a lesser magnetic flux density than what is required to attract the armature suffices. By lowering the operating current I by about 50%, the power loss can be reduced to about 25%, since for the closed magnetic circuit a lesser current is adequate for the requisite magnetic flux density. This lesser operating current I flows through the coil resistance of the coil and thus generates a lesser power loss, in the form of heat energy, compared with the higher operating current I prior to time t2.

The specific layout of the control circuit 16, which on the one hand performs the clocking of the operating current I in the control unit 14 and on the other lowers the operating current I, is not to be addressed in detail here. However, besides the trigger stage 19, it also includes a timer stage for the time t2 for switchover of the trigger stage from the higher response values a1 and b1 for turn-off (a1) and turn-on (b1) of the operating current $I_{ist}$ to the lower response values a2 and b2. In this example, after t2, which is approximately 30 ms long, the set-point value of the operating current I is lowered from 25 A to 12 A. For the control circuit 16, the use of well known multivibrators, precision Schmitt triggers or other suitable oscillator circuits, preferably including microprocessors, is attractive. The time period t2 until the current is lowered should be specified such that the relay armature will reliably lift away from its position of repose at an earlier time t1. Via the temperature detection circuit 20 it is possible to lower the limit values of the operating current $I_{ist}$, via the variable response values a and b of the trigger stage 19, as the temperature increases. Moreover, the time period t2 until the reduction of the operating current can thus also be shortened as the temperature increases. In this way it is possible to compensate for the temperature-dependent friction of the relay armature in motion and optionally for a temperature-dependent spring force of the armature restoring spring.

In FIGS. 3–6, signal courses for clocking the operating current I are shown. The signal course can be represented here by exact rectangular signals with an accurate duty cycle or in other words clock frequency. For furnishing the rectangular signals, the control circuit 16 may for instance include suitably designed function generators. In FIG. 3, for instance for a clock frequency of 2 kHz, the signal course is shown with a 30% duty cycle; that is, with reference to one unit of time (period), the operating current I is on for 30% of this unit of time while it is off for the remaining 70%. Accordingly, FIG. 4 shows a signal course with a 60% duty cycle, FIG. 5 a signal course with a 90% duty cycle, and FIG. 6 a signal course with a 100% duty cycle. Depending on the duty cycle chosen, the result is an area encompassed by the course of the line of the operating current I and thus, in a known manner, the energy supplied to the coil. The lower the clocking or in other words the on/off duty cycle chosen, the lower is the energy supplied and thus the power loss occurring in the coil.

By means of the clocking of the operating current I, it is thus also possible to vary the duty cycle as a function of certain operating parameters of the auxiliary relay 18. For instance, the duty cycle can be varied as a function of an operating temperature of the auxiliary relay 18 in order to maintain the specified operating current intensity. At the same time, lowering the operating current I can be accomplished via a reduction of the duty cycle, or it can be varied as a function of temperature.

Hence by a trigger stage 19 of the control circuit 16, with duty cycles chosen here merely as examples, the operating current I for an auxiliary relay 18 at the moment it is turned on can be acted upon for approximately 30 ms with a 60% clocking, while at time t2 (FIG. 2) the duty cycle is changed to 30%. Thus by simple generation of the rectangular signals of the trigger stage 19, the energy demand of the coil of the auxiliary relay 18 can be reduced drastically. By coupling the control circuit 16 to the temperature detection circuit 20, the clocking of the operating current I can be adapted in a simple way to whatever operating conditions prevail. For instance, it is expedient for a cold relay to furnish the operating current I with 60% clocking at the moment the relay is turned on and 30% clocking at time t2. For an auxiliary relay 18 at its normal operating temperature, the duty cycle at the moment it is turned on may amount to 90%, while at time t2 it is changed over to 50%. For a heated auxiliary relay 18, for instance, the clocking can be done at 100% at the turn-on moment, while a change to 60% clocking takes place at time t2. By means of the control circuit 16 and the temperature detection circuit 20, the time t2 for the changeover of the duty cycles can moreover be varied. For instance, for a cold auxiliary relay 18 the time t2 can be 30 ms; for a normally heated auxiliary relay 18, time t2 can be 25 ms, and for a heated auxiliary relay 18, the time t2 can be 15 ms.

It thus becomes clear that by means of the duty cycle and the instant of switchover of the duty cycle between the attraction range and the retention range of the auxiliary relay 18, triggering of the auxiliary relay 18 that enables a drastic energy savings is possible.

Overall, an operation of the auxiliary relay 18 can thus be established at a constant mean operating current value despite varying operating conditions and especially varying operating temperatures. Moreover—as noted—a reduction in the power loss of the auxiliary relay 18 is accomplished by the clocking of the operating current I.

By means of the constant mean operating current value under varying temperature conditions, the possibility arises of exerting influence on the structural embodiment of the auxiliary relay 18. On the one hand, it becomes possible to increase the spring force of the restoring spring for the armature of the auxiliary relay 18, since the auxiliary relay 18 no longer needs to be designed for the least favorable operating situation to be expected, namely the maximum operating current I at the maximum temperature. By increasing the spring force for the armature of the auxiliary relay 18, the tendency of the switch contact to bounce can be reduced, making it possible to increase the service life of the contacts. Another advantage is that by this increase in spring force and hence reduction in the tendency to bounce, it becomes possible to incorporate the auxiliary relay 18 into a housing of the starting relay 22. The accelerations or impacts at the starting device that occur during the switching operations of the starting relay 22, which can be in ranges up to from 5000 to 10,000 g can thus better be intercepted by the stronger spring force of the restoring spring of the auxiliary relay 18.

Moreover it is also possible, in the event that it is undesirable for major spring forces to have to be overcome, to reduce the coil winding of the auxiliary relay 18, since less energy input overall is necessary for function. Because as a result less installation space is required, better integration of the auxiliary relay 18 into the starting relay 22 is also made possible.

Figure 7:
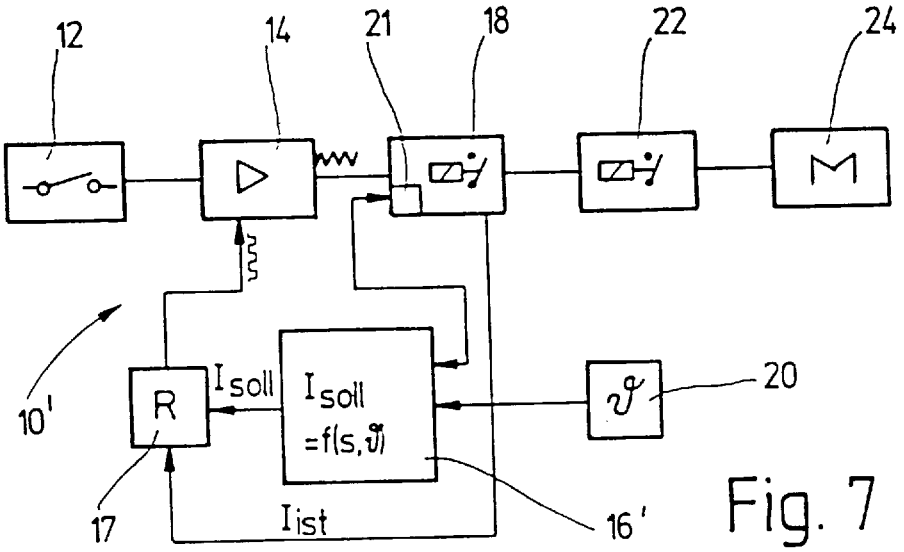
FIG. 7 a second exemplary embodiment of the circuit arrangement according to the invention.
Figure 8:
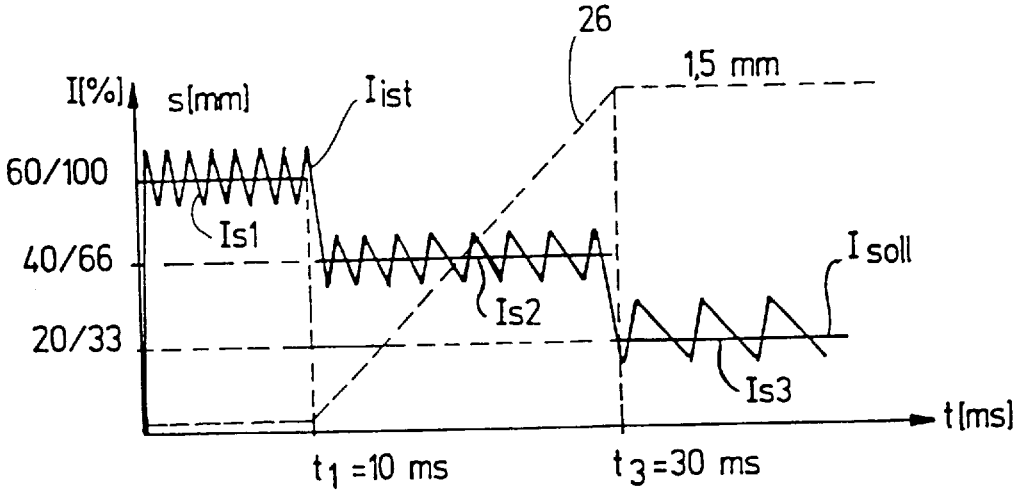
FIG. 8, a diagram of the course of the set-point and actual value of the operating current for the auxiliary relay according to the embodiment of FIG. 7.

Clocking of a starter auxiliary relay is possible not only with the aid of the control circuit explained in conjunction with FIGS. 1 and 2; it can also be attained with a control and regulating circuit as in FIGS. 7 and 8. There, the operating current of the control relay is clocked by a regulator 17 via a clocking stage in the control unit 14' in such a way that the mean current value established in connection with the is regulated to a predetermined set-point value $I_{soll}$. To that end, the actual value of the operating current $I_{ist}$, which varies continuously because of the clocking, is sensed at the auxiliary relay 18. The drop in the set-point value can now be accomplished as a function of time after the turn-on of the relay or with the aid of a further sensor 21 and the connected control circuit 16' as a function of the position of the auxiliary relay armature.

As shown in the accompanying graph (FIG. 8), it is contemplated that before the onset of motion of the relay armature, regulation is done to the set-point current Is1, and to the lesser set-point current Is2 when the armature is in motion and to the even lower set-point current Is3 when the relay armature is fully in its track.

The winding is designed such that at 0° C. and with regulation to Is1, for instance, a duty cycle of 60% is reliably adequate for a relay armature motion (duty cycles at an identical relay armature location and Is2 at 40%, for example and at Is3 20%, for example). At the maximum winding temperature (+100° C., for instance), at the relay currents regulated as above, because of the higher winding resistance, a duty cycle of 100% results at Is1 (66% at Is2, 33% at Is3).

The relay current is accordingly regulated fundamentally independently of interfering variables (such as temperature, battery voltage, etc.) but in dependence on the status of the relay armature (position, speed, for instance) and on the demand for magnetic force. The duty cycle is automatically correctly set by the regulator.

Overall, the result is thus a relay current regulation dependent on the relay armature force requirement, having the following advantages in particular:

thermal relief reduced impacts on armature contact, reduced bouncing increased functional safety (higher armature attraction force)

increased relay service life

We claim:

1. A circuit arrangement for an auxiliary relay that actuates a starting relay for a starter device of an internal combustion engine, said circuit arrangement comprising a temperature measuring means (20) and a control and/or regulating circuit means (16,16') for controlling, in a turned-on state, an operating current (I) flowing through a relay coil of the auxiliary relay according to a temperature measured by the temperature measuring means (20) so that the operating current (I) and a mean value of the operating current (I) are controlled according to said temperature, wherein said temperature measuring means (20) is arranged so that said temperature is that of the auxiliary relay (18) or the starting relay (24).

2. The circuit arrangement as defined in claim 1, wherein the control and/or regulating circuit means (16,16') includes a clocking stage for a clocked current circuit.

3. The circuit arrangement as defined in claim 1, wherein the control and/or regulating circuit means (16,16') has a trigger stage (19) for clocking the operating current (I) with a certain variable duty cycle.

4. The circuit arrangement as defined in claim 3, wherein the duty cycle of the operating current (I) is variable over time.

5. The circuit arrangement as defined in claim 3, wherein the control and/or regulating circuit means (16,16') includes means for lowering the operating current (I) to a lowered operating current after a predetermined time (t2) has been reached.

6. The circuit arrangement as defined in claim 5, wherein the means for lowering the operating current (I) lowers the operating current (I) after starting motion of an armature of the auxiliary relay (18) from a rest position or when the armature reaches an operating position thereof.

7. The circuit arrangement as defined in claim 5, wherein the lowered operating current has a lower duty cycle than the operating current (I) prior to the lowering by the means for lowering.

8. A circuit arrangement for an auxiliary relay that actuates a starting relay for a starter device of an internal combustion engine, said circuit arrangement comprising a temperature measuring means and a control and/or regulating circuit means (16,16') for controlling, in a turned-on state, a duty cycle of an operating current (I) flowing through a relay coil of the auxiliary relay according to a temperature measured by the temperature measuring means (20) so that the operating current (I) is lowered when said temperature increases, wherein said temperature measuring means is arranged so that said temperature is that of the auxiliary relay (18) or the internal combustion engine.

9. The circuit arrangement as defined in claim 8, wherein the control and/or regulating circuit means (16,16') lowers the duty cycle of the operating current at a variable time (t2) and means for determining said variable time (t2) according to said temperature of said auxiliary relay (18) or said internal combustion engine.

10. The circuit arrangement as defined in claim 8, wherein the control and/or regulating circuit means (16,16') controls the duty cycle of the operating current according to an armature position of the auxiliary relay (18).

11. The circuit arrangement as defined in claim 8, wherein the control and/or regulating circuit means (16,16') has a trigger stage (19) for clocking the operating current and controls the operating current (I) of the relay coil so that a required attraction force is produced at a maximum allowable operating temperature when the duty cycle of the operating current is 100%.

12. The circuit arrangement as defined in claim 8, wherein the control and/or regulating circuit means (16,16') has a trigger stage (19) for clocking the operating current and lowers the operating current (I) from a first set-point value ($I_{soll}$) to at least one additional lower set-point value after a time (t1, t2, t3).

13. The circuit arrangement as defined in claim 12, wherein the control and/or regulating circuit means (16,16') lowers the operating current (I) in two steps according to a turn-on time (t1,t2) or an armature position of the auxiliary relay (18).

* * * * *